US005261552A

United States Patent [19]

L'Hotel et al.

[11] Patent Number: 5,261,552

[45] Date of Patent: Nov. 16, 1993

[54] BOX OR CASE DEVICE WITH A MOVABLE LID

[75] Inventors: Francois L'Hotel; Jacques Tenenhaus; Sylvie Dugain, all of Paris, France

[73] Assignee: Marin's Edition, Paris, France

[21] Appl. No.: 669,851

[22] Filed: Mar. 15, 1991

[30] Foreign Application Priority Data

Mar. 16, 1990 [FR] France ..... 90 03377

[51] Int. Cl.[5] ..... B65D 43/14

[52] U.S. Cl. ..... 220/337; 220/335; 220/338

[58] Field of Search ..... 220/337, 338, 342, 343, 220/335, 377; 16/224, 374, 380

[56] References Cited

U.S. PATENT DOCUMENTS 660,739 10/1990 Taylor ..... 220/377 X 2,765,949 10/1956 Hillman ..... 220/338

3,394,835 7/1968 Peterson ..... 220/337

4,779,756 10/1988 Buelens et al. ..... 220/306 X 4,880,139 11/1989 Jumel et al. ..... 220/337

FOREIGN PATENT DOCUMENTS 2458243 2/1981 France .

2584583 1/1987 France .

*Primary Examiner*—Stephen Marcus

*Assistant Examiner*—Paul A. Schwarz

*Attorney, Agent, or Firm*—Watson, Cole, Grindle & Watson

[57] ABSTRACT

Box or case for a lighter or the like has a hinge the hinge including a flat tenon integral with one of the parts and engaging into a slot provided on the other part, the tenon being equipped with pins interacting with identations formed laterally on the slot and opening towards the inside of the case.

6 Claims, 1 Drawing Sheet

FIG.:1
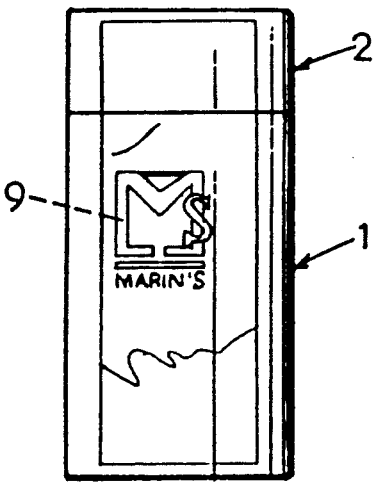
FIG.:2
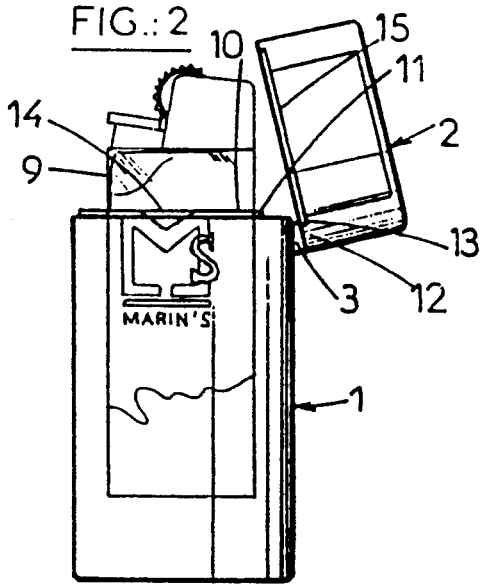
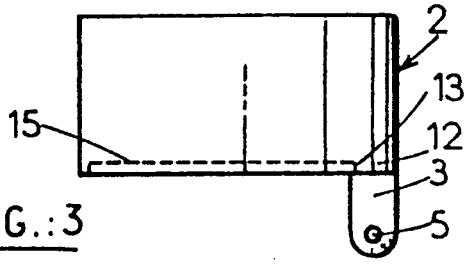
FIG.:3
FIG.:4
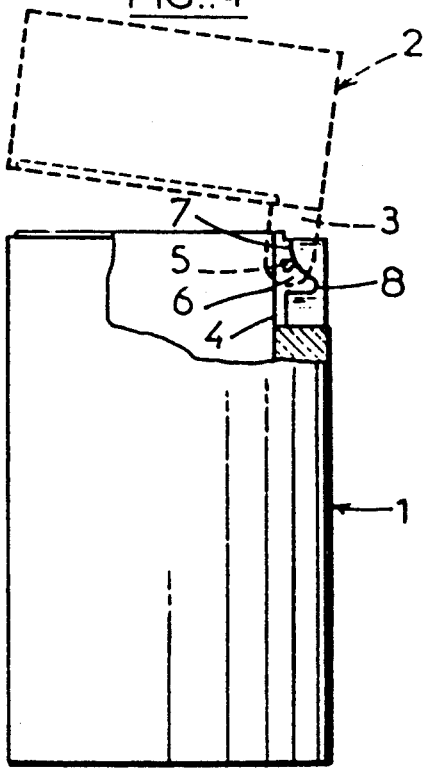
FIG.:5
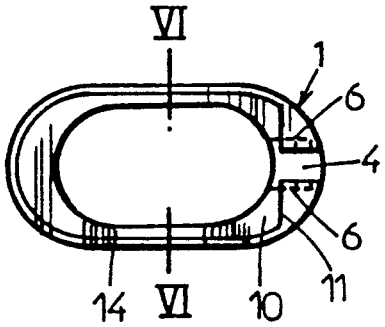
FIG.:6
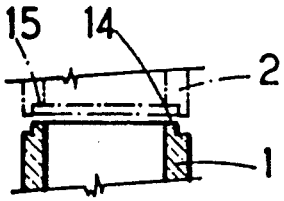

BOX OR CASE DEVICE WITH A MOVABLE LID

The present invention relates to an articulated box or lid which can serve for housing a utility article, such as a lighter, perfume tube, spray, flashlight, highlighter, etc.

More particularly, the invention relates to a hinge device between the box and lid which is designed to be simple and inexpensive.

Already known—from patents BE-A-338,194 and DE-U-8,325,984—are simple hinge devices consisting of pins which are carried by one of the parts, either the box or the lid, and which each engage into a receptacle provided in the other part. The pins can be introduced into their receptacles only by utilizing the elasticity of the material of at least one of the parts, and therefore these structures are unsuitable when the box and its lid are both made of a relatively rigid material.

There has also been proposed, GB-A-2,047,311, a window joint, in which the aperture carries two pairs of tenons, each pair engaging into a groove which opens outwardly and which has a form designed for keeping the window in a closed position or for allowing it to pivot. This arrangement demands a high mechanical resistance of the tenons, this being incompatible with the small dimensions corresponding to a box of relatively small size.

The object of the present invention is to provide a box with an articulated lid which can be produced from a relatively rigid material, without requiring a high mechanical resistance in the region of the hinge.

To achieve this result, the invention provides a box with an articulated lid in two parts, of which one forms the lid and the other the box body and of which the hinge consists of a tenon integral with one of the parts and carrying pins which are opposite one another and which engage into receptacles provided in the other part, the particular feature of which is that the tenon engages into a slot provided in the wall of the other part and open towards the inside of the latter, and the receptacles of the pins consist of indentations made laterally on the slot and opening only towards the inside of the case.

According to an advantageous embodiment, when the article for which the box is intended is rigid and of predetermined dimensions, the inner dimensions of the box are such that the article, when in the box, sufficiently prevents a displacement of the tenon towards the inside of the box to prevent the pins from coming out of their receptacles.

Thus, the lid cannot escape as long as the article is in the box.

According to another advantageous embodiment which can be added to the foregoing, complementary reliefs are provided on the mutually confronting surfaces of the parts, these reliefs being such that, when the box is closed, they sufficiently prevent a displacement of the tenon towards the inside of the box to prevent the pins from coming out of their receptacles. Thus, the lid cannot escape. The lid can be kept in the closed position by all suitable means. Preferably, for greater simplicity, an interlocking connection will be used between at least some of the projections and recesses of the box and of the lid.

Advantageously, the tenon terminates in a part in the form of an arc of a circle, the center of which is located substantially on the common axis of the pins and the radius of which is substantially equal to the distance separating the bottom of each indentation from the inside of the box. It is sufficient, in this case, that the contents of the box be rigid so that the tenon, by bearing on these contents, keeps the pins at the bottom of the groove, thus ensuring a uniform and smooth operation of the hinge, the geometrical pivot axis of which is kept stationary.

If the lid is produced from plastic, it is advantageous to make the tenon in one piece with the lid, thereby simplifying production.

An original presentation will be obtained if at least one zone of the case is produced from transparent or translucid and colorless or colored material and if a slight play is provided between the interior of the case and the article contained in it, so that a publicity or decorative sheet can be slipped between the two in front of the transparent or translucid zone.

It is expedient to note that, in the particular instance of a lighter, producing a case with a specific wall thickness makes it possible to increase the gap between the fingers and the lighter and prevent excessive heating of the hand which can be a risk with small-size lighters found in the trade.

The description which follows, made with reference to the accompanying drawing given by way of non-limiting example, will make it easy to understand how the invention can be put into practice, the particular features emerging both from the drawing and from the text of course forming part of the invention.

FIG. 1 is an elevation view of an article according to the invention, with the lid closed.

FIG. 2 shows the same article, with the lid open and the content partially extracted, FIG. 3 shows the lid on a larger scale, FIG. 4 is a partially cut away elevation view of the body of the case, FIG. 5 shows the case in horizontal projection, with the lid removed, and FIG. 6 is a sectional view taken substantiality along the line VI—VI of FIG. 5 with the lid being shown in phantom outline.

The drawings show a case 1 of oblong shape, such as the shape of a gas lighter or a small flashlight, the case 1 being equipped with an articulated lid 2.

The joint articulating this lid on the case comprises a tenon 3 integral with the lid and engaging into a slot 4 provided in the wall of the case.

The tenon carries two projecting pins 5 opposite one another. The end of the tenon 3 which is opposite the lid has the form of an arc of a circle, in practice only a semicircle for the sake of easier production, and the center of the circle arc is substantially on the common axis of the pins 5.

On the mutually opposite walls of the slot 4 there are two indentations 6, into which the pins 5 can engage.

The profile of these indentations (FIG. 4) has, towards the orifice of the case, an inclined part 7 terminating, on the side opposite this orifice, in a rounded portion 8 of a diameter suitable for receiving the pins 5 forming pivots.

That face of the edge of the case confronting the lid has, in the vicinity of the slot 4, a part in relief 10 limited by a shoulder 11 facing outwardly. That face of the lid confronting the case has correspondingly, a recessed part 12 limited by a shoulder 13 which, when the lid is in the closing position, comes to bear against the shoulder 11 or is at a slight distance therefrom. It will be appreciated that the presence of these shoulders prevents a displacement of the lid towards the left in the Figures, that is to say the displacement of the tenon and of the pins towards the inside of the case. Consequently, the pins cannot come out of the indentations as long as the lid is closed, thus preventing the accidental loss of the lid when the case is empty.

To keep the lid in the closed position, there is provided a snap connection by means of a projecting and undercut ring 14 extending along the part in relief 10 on the periphery of the edge of the case and of a notch 15 of complementary form on the edge of the lid. FIG. 6 shows the ring and the match in detail.

When the case is empty, in order to remove the lid it is first necessary to cause it to pivot about the pins 5 so as to break the snap connection, and continue the movement until the shoulders 11 and 13 no longer interact. The tenon 3 can then be displaced towards the inside of the case, until the pins 5 come out of the indentations. This operation is illustrated in FIG. 4.

If the article, such as a lighter a or the like, is placed in the case, the semicircular end of the tenon comes to bear on the article and prevents the movement from continuing, with the result that the pins cannot come out of the indentations. The lid therefore cannot escape. The radius of the semicircular end part of the tenon 3 is approximately equal to the distance between the rounded bottom 8 of the indentation 6 and the article contained in the case. As a result of this, the pins 5 are kept in these rounded portions 8, to ensure a satisfactory operation of the hinge.

With the lid first being separated from the case, by placing it in a position near to closing (position represented by broken lines in FIG. 4) the pins 5 can be engaged in the indentations against the oblique parts 7, and then by pushing on the lid the pins can be placed in the round parts 8, the lid from that moment being secured to the case. It will be locked on the case, While at the same time being pivotable, when the article, such as a lighter or the like, is placed in the case.

Since the case is made of transparent or translucid material, by means of a slight play provided between the case and the article contained in it, it will be possible to place in the gap a flexible publicity, decorative or any other type of sheet which will be seen through the case from outside.

We claim:

1. A box adapted for containing a rigid article of predetermined dimension, the box comprising two parts, one of said parts forming a box body and the other of said parts forming a lid, the two parts being connected by means of a hinge comprising a tenon fixed to the lid and engaging into a slot provided in a wall of the box and opening toward the inside of the box body, the tenon having opposing pins which engage into receptacles comprising identations formed laterally in a wall of the slot and opening only towards the inside of the box body, wherein the inner dimensions of the box body are such that the article, when contained in the box body, prevents displacement of the tenon toward the inside of the box body to prevent the pins from disengaging the receptacles.

2. The box as claimed in claim 1, wherein the parts have mutually confronting surfaces with complementary reliefs provided thereon, the reliefs being such that, in a lid closing position, the reliefs prevent a displacement of the tenon towards the inside of the box body to prevent the pins from disengaging the receptacles.

3. The box as claimed in claim 2, wherein there are provided between the reliefs of the parts interlocking connections which oppose an undesirable opening of the box.

4. The box as claimed in claim 1, wherein the identations for receiving the pins comprise an inclined part for the engagement of the pins and a rounded bottom for receiving the pins and allowing them to pivot.

5. The box as claimed in claim 1, wherein the lid is of plastic material, the tenon and the pins being integral with the lid.

6. The box as claimed in claim 1, wherein at least one area of the wall of the one part is transparent or translucid and the inner dimensions of the box body are such as to permit introduction of a flexible publicity or decorative sheet into a gap formed between the article and the wall of the box body in front of the transparent or translucid area.

* * * * *